US011710937B2

(12) United States Patent
Utsunomiya et al.

(10) Patent No.: US 11,710,937 B2
(45) Date of Patent: Jul. 25, 2023

(54) ELECTRONIC-COMPONENT-EQUIPPED TERMINAL BLOCK, ELECTRONIC DEVICE, AND ATTACHMENT ASSISTANCE TOOL FOR ELECTRONIC COMPONENT

(71) Applicant: OMRON Corporation, Kyoto (JP)

(72) Inventors: Hiroki Utsunomiya, Kusatsu (JP); Ryohei Yoshioka, Kusatsu (JP); Shinya Iwasaki, Ritto (JP)

(73) Assignee: OMRON CORPORATION, Kyoto (JP)

( * ) Notice: Subject to any disclaimer, the term of this patent is extended or adjusted under 35 U.S.C. 154(b) by 80 days.

(21) Appl. No.: 17/434,126

(22) PCT Filed: Feb. 5, 2020

(86) PCT No.: PCT/JP2020/004348
§ 371 (c)(1),
(2) Date: Aug. 26, 2021

(87) PCT Pub. No.: WO2020/189067
PCT Pub. Date: Sep. 24, 2020

(65) Prior Publication Data

US 2022/0149577 A1 May 12, 2022

(30) Foreign Application Priority Data

Mar. 15, 2019 (JP) ..... 2019-048190

(51) Int. Cl.
*H01R 43/00* (2006.01)
*H01R 43/22* (2006.01)
(Continued)

(52) U.S. Cl.
CPC ..... *H01R 43/22* (2013.01); *H01R 4/48* (2013.01); *H01R 9/24* (2013.01)

(58) Field of Classification Search
CPC ..... H01R 43/22; H01R 4/48; H01R 9/23
See application file for complete search history.

(56) References Cited

U.S. PATENT DOCUMENTS 9,568,682 B1 * 2/2017 Barwicz ..... G02B 6/362
10,587,059 B2 * 3/2020 Masaki ..... H01R 9/26
(Continued)

FOREIGN PATENT DOCUMENTS

CN 103715525 A 4/2014
CN 109149319 A 1/2019
(Continued)

OTHER PUBLICATIONS

International Search Report of PCT/JP2020/004348 dated Mar. 24, 2020 [PCT/ISA/210].
(Continued)

*Primary Examiner* — Phuong Chi Thi Nguyen
(74) *Attorney, Agent, or Firm* — Sughrue Mion, PLLC

(57) ABSTRACT

An electronic-component-equipped terminal block includes a terminal block including first and second through holes provided in a front wall; an electronic component including a component body first and second leads; and an electrically insulating attachment assistance tool. The attachment assistance tool includes a base portion arranged outside a housing such that a rear surface thereof abuts against the front wall; and first and second insertion portions protruding from the rear surface of the base portion to be thereby inserted into the first and second through hole, respectively. The attachment assistance tool is provided with a first passage portion through which the first lead is inserted, and a second passage portion through which the second lead is inserted, and a receiving portion that receives and accommodates a rear portion of the component body is provided at a front-side position.

18 Claims, 10 Drawing Sheets

(51) Int. Cl.
*H01R 4/48* (2006.01)
*H01R 9/24* (2006.01)

(56) References Cited

U.S. PATENT DOCUMENTS

| | | | | |
|---|---|---|---|---|
| 10,686,262 | B2 * | 6/2020 | Wu | H01R 4/4818 |
| 2001/0034165 | A1 | 10/2001 | Landis et al. | |
| 2014/0017930 | A1 * | 1/2014 | Sasano | H01R 9/2625<br>439/370 |
| 2018/0337472 | A1 | 11/2018 | Wu et al. | |
| 2022/0149577 | A1 * | 5/2022 | Utsunomiya | H01R 4/48 |

FOREIGN PATENT DOCUMENTS

| | | | |
|---|---|---|---|
| EP | 3678262 | A1 | 7/2020 |
| JP | 2001-313103 | A | 11/2001 |
| JP | 2004-150836 | A | 5/2004 |
| WO | 2016/169821 | A1 | 10/2016 |

OTHER PUBLICATIONS

Extended European Search Report dated Oct. 31, 2022 from the European Patent Office in EP Application No. 20774276.8.
Office Action dated Feb. 13, 2023 in Chinese Application No. 202080017654.9.

* cited by examiner

3

ELECTRONIC-COMPONENT-EQUIPPED TERMINAL BLOCK, ELECTRONIC DEVICE, AND ATTACHMENT ASSISTANCE TOOL FOR ELECTRONIC COMPONENT

CROSS REFERENCE TO RELATED APPLICATIONS

This application is a National Stage of International Application No. PCT/JP2020/004348, filed Feb. 5, 2020, claiming priority to Japanese Patent Application No. 2019-048190, filed Mar. 15, 2019, the entire contents of each of which being herein incorporated by reference in their entireties.

TECHNICAL FIELD

The present disclosure relates to an electronic-component-equipped terminal block in which the electronic component is preliminarily attached to the terminal block, an electronic device including the electronic-component-equipped terminal block, and an attachment assistance tool for the electronic component (hereinafter, also simply referred to as "attachment assistance tool") configured to be interposed between the electronic component attached to the terminal block and the terminal block.

BACKGROUND ART

An I/O unit of a programmable logic controller (PLC) has been conventionally known as an electronic device including a terminal block provided with a plurality of sets of general-purpose terminal connection portions, each set of which includes a pair of terminal portions. A temperature input unit and a temperature adjusting unit (hereinafter, collectively referred to as "temperature measuring unit") of the I/O unit can measure a temperature by using a thermocouple/thermocouples connected to one or more sets of the plurality of sets of general-purpose terminal connection portions described above.

When a temperature is measured by using the thermocouple connected to the pair of terminal portions of the set of general-purpose terminal connection portions of the temperature measuring unit, a large difference may occur between a temperature measured by the thermocouple and a temperature to be actually measured, due to an influence of a terminal block temperature.

As a method for preventing the difference in temperature measurement, there is known a method for compensating for the above-described difference by mounting a cold junction sensor, which is an electronic component, on the temperature measuring unit to measure the terminal block temperature of the temperature measuring unit, and using the terminal block temperature of the temperature measuring unit measured with the cold junction sensor. Such a method is specifically disclosed in, for example, Japanese Patent Laying-Open No. 2004-150836 (PTL 1).

The above-described literature describes that the cold junction sensor is provided in a portion of the temperature measuring unit located near one set of general-purpose terminal connection portions to which the thermocouple is connected. However, the above-described literature does not specifically mention how and at which position the cold junction sensor is provided.

CITATION LIST

Patent Literature

PTL 1: Japanese Patent Laying-Open No. 2004-150836

SUMMARY OF INVENTION

Technical Problem

Although there are various methods for placing the above-described cold junction sensor, one of the methods is to preliminarily attach the cold junction sensor from outside to a predetermined or arbitrarily selected particular set of a plurality of sets of general-purpose terminal connection portions provided in a terminal block. According to this method, the cold junction sensor is preliminarily attached to the terminal block by preliminarily inserting a pair of leads of the cold junction sensor into a pair of through holes of the terminal block provided to correspond to a pair of terminal portions of the above-described particular set of general-purpose terminal connection portions, thereby connecting the pair of leads to the pair of terminal portions.

Such a configuration makes the set of the plurality of sets of general-purpose terminal connection portions provided in the terminal block unavailable as general-purpose terminal connection portions. However, such a configuration provides an effect of being able to easily attach the cold junction sensor to the terminal block. Besides that, a component body of the cold junction sensor can be placed outside a temperature measuring unit, which allows more accurate measurement of a temperature of the pair of terminal portions of the set of general-purpose terminal connection portions. As a result, an influence of heat generation in the temperature measuring unit is small and degradation in accuracy of temperature measurement can be prevented more reliably.

However, the set of general-purpose terminal connection portions including the pair of through holes and the pair of terminal portions described above is configured to have a relatively large dimension so as to be able to receive terminals having various shapes and sizes, whereas the pair of leads of the cold junction sensor have a very thin shape. Therefore, when the cold junction sensor is attached to the set of general-purpose terminal connection portions from outside, the attachment state tends to be unstable, and a connection failure of the cold junction sensor may occur when external force is applied to the cold junction sensor, the terminal block, the temperature measuring unit and the like.

Accordingly, the present disclosure has been made in light of the above-described problem, and an object of the present disclosure is to provide an electronic-component-equipped terminal block, and an electronic device including the same, in which a state of attachment of the electronic component to the terminal block is stabilized. Another object of the present disclosure is to provide an attachment assistance tool for an electronic component that can stabilize the attachment state when the electronic component is attached to the terminal block.

Solution to Problem

An electronic-component-equipped terminal block according to an aspect of the present disclosure includes: a terminal block; an electronic component attached to the terminal block; and an electrically insulating attachment assistance tool interposed between the electronic component and the terminal block. The terminal block includes: a housing having, in a front wall thereof, a first through hole and a second through hole provided to reach an accommodating portion formed inside the housing; a first terminal portion arranged in the accommodating portion so as to face the first through hole; and a second terminal portion arranged in the accommodating portion so as to face the second through hole. The electronic component includes: a component body arranged outside the housing so as to face the front wall; a first lead inserted through the first through hole and connected to the first terminal portion; and a second lead inserted through the second through hole and connected to the second terminal portion. The attachment assistance tool includes: a base portion arranged outside the housing such that a rear surface thereof abuts against the front wall and a part thereof faces the first through hole and the second through hole; a first insertion portion protruding from the rear surface of the base portion to be thereby inserted into the first through hole; and a second insertion portion protruding from the rear surface of the base portion to be thereby inserted into the second through hole. In the electronic-component-equipped terminal block according to the above-described aspect of the present disclosure, a hollow first passage portion through which the first lead is inserted is provided to extend from the base portion to the first insertion portion, a hollow second passage portion through which the second lead is inserted is provided to extend from the base portion to the second insertion portion, and a receiving portion that receives and accommodates at least a rear portion of the component body is provided at a front-side position of the base portion.

With such a configuration, the first insertion portion and the second insertion portion of the attachment assistance tool for the electronic component are interposed between the first through hole provided in the front wall of the housing of the terminal block and the first lead of the electronic component and between the second through hole provided in the front wall of the housing of the terminal block and the second lead of the electronic component, respectively. Therefore, a state of attachment of the electronic component to the terminal block is stabilized. In addition, the receiving portion that receives and accommodates at least the rear portion of the component body of the electronic component is provided at the front-side position of the attachment assistance tool for the electronic component. Therefore, the state of attachment of the electronic component is stabilized. Besides that, the electronic component and the attachment assistance tool for the electronic component do not project greatly at the front-side position of the terminal block, and thus, interference caused by the electronic component and the attachment assistance tool for the electronic component can be avoided.

In the electronic-component-equipped terminal block according to the above-described aspect of the present disclosure, the receiving portion is preferably located at least between the first passage portion and the second passage portion.

With such a configuration, the electronic component whose rear portion is at least accommodated in the receiving portion is arranged between the first through hole and the second through hole at the front-side position of the terminal block. Therefore, the electronic component and the attachment assistance tool for the electronic component do not greatly project outward from the front-side region of the portion of the terminal block provided with the first through hole and the second through hole, and thus, interference caused by the electronic component and the attachment assistance tool for the electronic component can be further avoided.

In the electronic-component-equipped terminal block according to the above-described aspect of the present disclosure, the base portion may have a pair of erected wall portions that face each other in a direction orthogonal to a direction connecting the first passage portion and the second passage portion, when viewed from a front side, and in this case, the receiving portion is preferably defined by the pair of erected wall portions.

With such a configuration, at the front-side position of the terminal block, the component body of the electronic component can be sandwiched by the pair of erected wall portions along the direction orthogonal to the direction connecting the first passage portion and the second passage portion. Therefore, the component body of the electronic component can be received and accommodated more stably by the receiving portion.

In the electronic-component-equipped terminal block according to the above-described aspect of the present disclosure, the base portion is preferably not located between the pair of erected wall portions, when viewed from the front side.

With such a configuration, the attachment assistance tool for the electronic component is not located between the portion of the component body of the electronic component accommodated in the receiving portion and the front wall of the terminal block. Therefore, an amount of projection of the electronic component and the attachment assistance tool for the electronic component at the front-side position of the terminal block can be minimized. Thus, interference caused by the electronic component and the attachment assistance tool for the electronic component can be avoided at the maximum.

In the electronic-component-equipped terminal block according to the above-described aspect of the present disclosure, the first passage portion preferably has a first guide portion having a passage cross-sectional area that decreases with increasing distance from the base portion, to thereby guide the first lead to the first terminal portion, and the second passage portion preferably has a second guide portion having a passage cross-sectional area that decreases with increasing distance from the base portion, to thereby guide the second lead to the second terminal portion.

With such a configuration, when the electronic component is attached to the terminal block, the first lead and the second lead of the electronic component are guided by the first guide portion and the second guide portion and connected to the first terminal portion and the second terminal portion, respectively. Therefore, the appropriate connection positions can be achieved and the attachment work can be simplified. After the electronic component is attached, the occurrence of misalignment of the first lead and the second lead in the direction orthogonal to the connection directions of the first lead and the second lead can be suppressed, and as a result, the occurrence of a connection failure can be prevented.

In the electronic-component-equipped terminal block according to the above-described aspect of the present disclosure, the base portion may be provided with a first frame-like portion that surrounds at least a part of the first passage portion when viewed from the front side, and the base portion may be provided with a second frame-like portion that surrounds at least a part of the second passage portion when viewed from the front side. In this case, each of a rear surface of the first frame-like portion and a rear surface of the second frame-like portion preferably abuts against the front wall.

With such a configuration, the attachment assistance tool for the electronic component interposed between the electronic component and the terminal block is stably positioned and held with respect to the terminal block. As a result, the state of attachment of the electronic component to the terminal block can be further stabilized.

An electronic device according to an aspect of the present disclosure includes the electronic-component-equipped terminal block according to the above-described aspect of the present disclosure.

Such a configuration can provide the electronic device in which the state of attachment of the electronic component to the terminal block is stabilized.

An attachment assistance tool for an electronic component according to an aspect of the present disclosure is configured to be interposed between an electronic component attached to a terminal block and the terminal block, the attachment assistance tool including: a base portion configured to be arranged outside a housing of the terminal block such that a rear surface thereof abuts against a front wall of the housing of the terminal block and a part thereof faces a first through hole of the terminal block and a second through hole of the terminal block; a first insertion portion protruding from the rear surface of the base portion to be thereby inserted into the first through hole of the terminal block; and a second insertion portion protruding from the rear surface of the base portion to be thereby inserted into the second through hole of the terminal block. In the attachment assistance tool according to the above-described aspect of the present disclosure, a hollow first passage portion through which a first lead of the electronic component is inserted is provided to extend from the base portion to the first insertion portion, a hollow second passage portion through which a second lead of the electronic component is inserted is provided to extend from the base portion to the second insertion portion, and a receiving portion configured to receive and accommodate at least a rear portion of a component body of the electronic component is provided at a front-side position of the base portion.

Such a configuration can provide the attachment assistance tool for the electronic component that can stabilize the attachment state when the electronic component is attached to the terminal block.

Advantageous Effects of Invention

According to an aspect of the present disclosure, there can be provided an electronic-component-equipped terminal block, and an electronic device including the same, in which a state of attachment of the electronic component to the terminal block is stabilized. According to another aspect of the present disclosure, there can be provided an attachment assistance tool for an electronic component that can stabilize the attachment state when the electronic component is attached to the terminal block.

DESCRIPTION OF EMBODIMENTS

Figure 1:
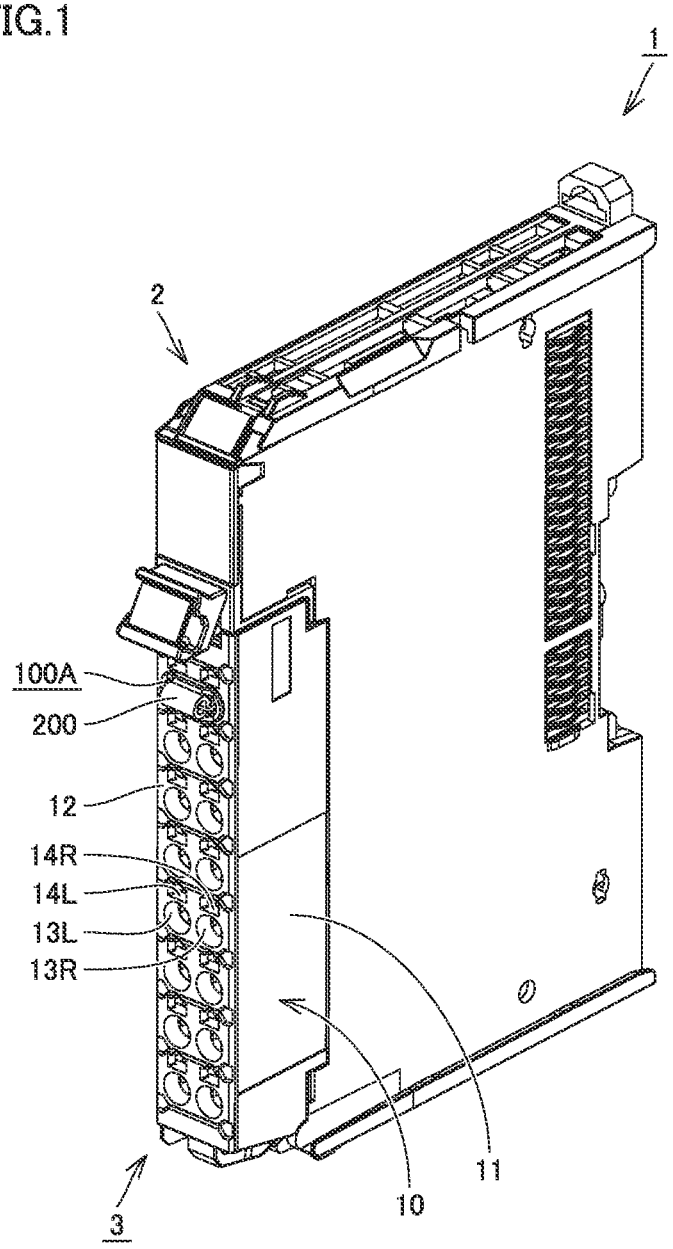
FIG. 1 is a perspective view of an electronic device according to an embodiment.

An embodiment will be described in detail hereinafter with reference to the drawings. The embodiment below illustrates a temperature measuring unit (i.e., a temperature input unit or a temperature adjusting unit) of a PLC, an electronic-component-equipped terminal block included therein, and an attachment assistance tool for the electronic component used therefor. In the embodiment described below, the same or corresponding portions are denoted by the same reference characters in the drawings, and description thereof will not be repeated.

Figure 2:
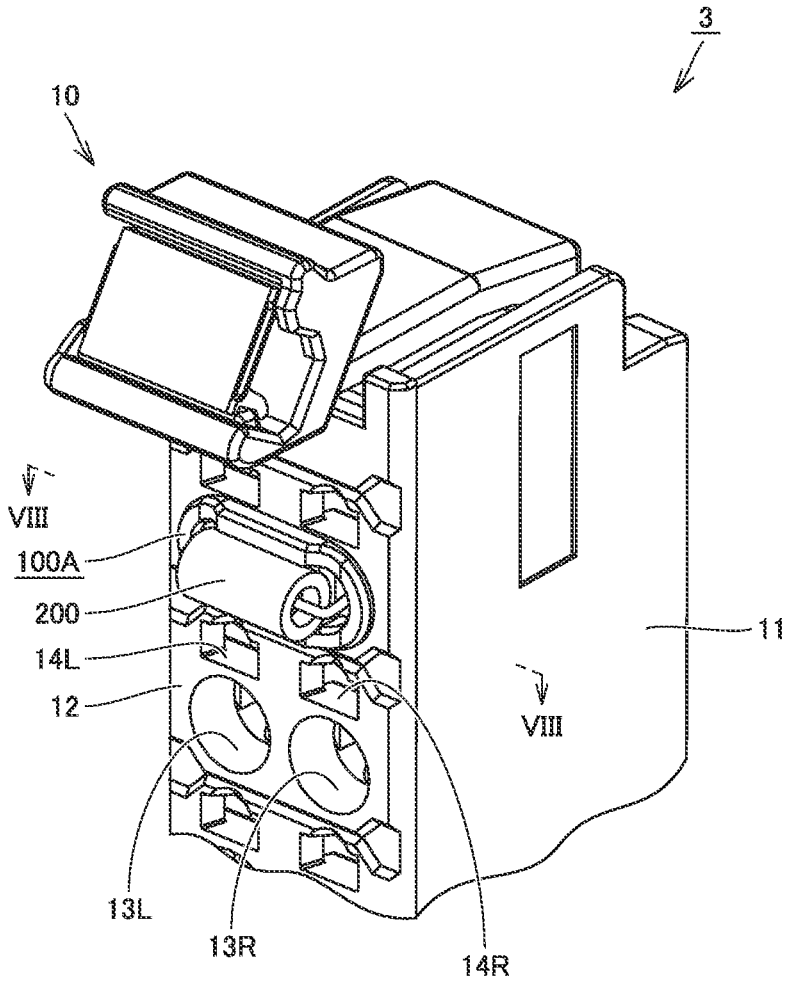
FIG. 2 is an enlarged perspective view of a main portion of an electronic-component-equipped terminal block according to the embodiment.
Figure 3:
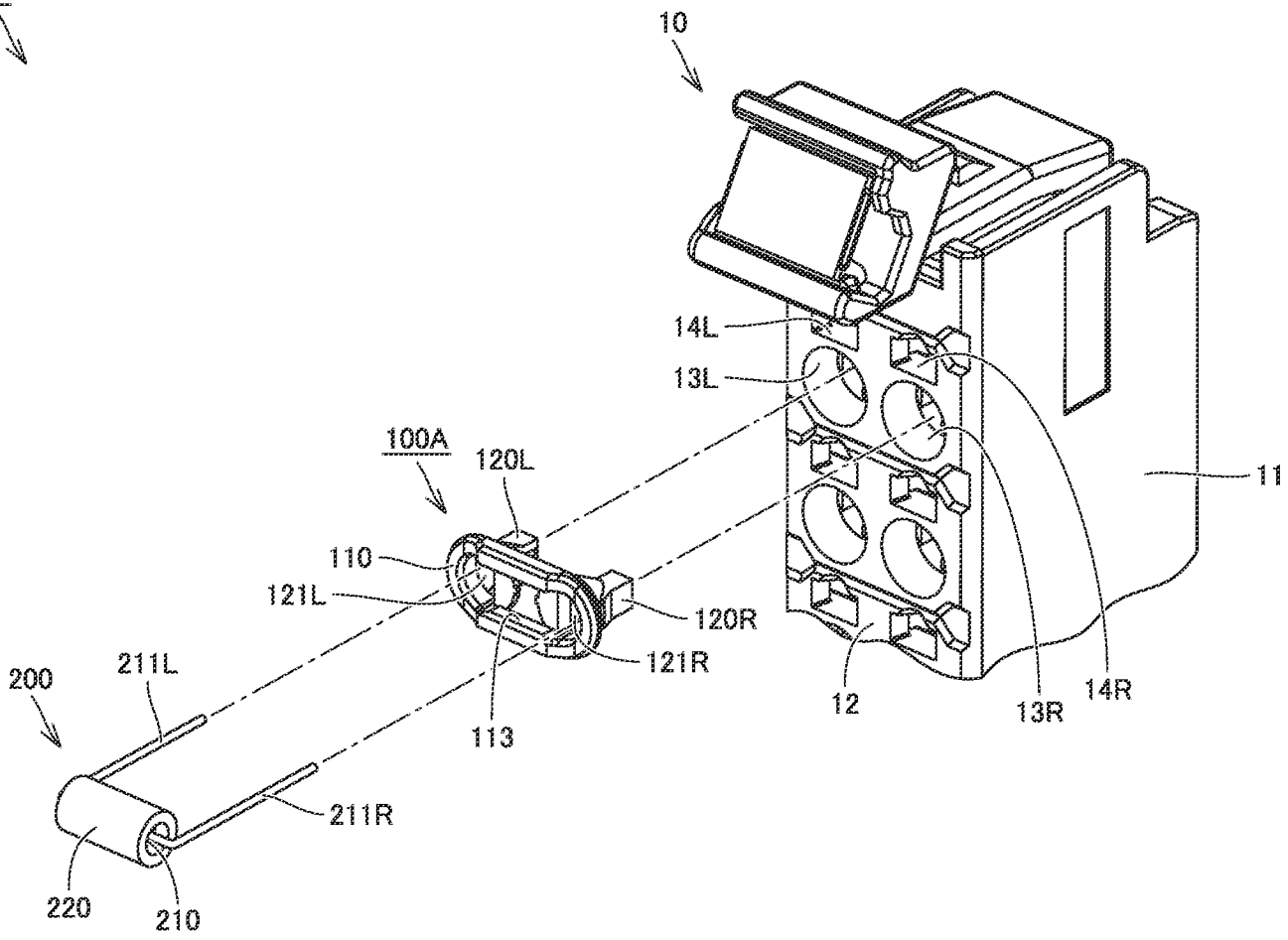
FIG. 3 is an exploded perspective view of the main portion of the electronic-component-equipped terminal block according to the embodiment.

A. Schematic Configurations of Electronic Device and Electronic-Component-Equipped Terminal Block FIG. 1 is a perspective view of an electronic device according to an embodiment. FIG. 2 is an enlarged perspective view of a main portion of a terminal block shown in FIG. 1. FIG. 3 is an exploded perspective view of the main portion of the terminal block shown in FIG. 2. First, schematic configurations of an electronic device 1 according to the embodiment and an electronic-component-equipped terminal block 3 included therein will be described with reference to FIGS. 1 to 3.

As shown in FIG. 1, electronic device 1 serving as a temperature measuring unit of a PLC has a flat and substantially rectangular parallelepiped outer shape configured such that an outer dimension in an up/down direction and an outer dimension in a front/rear direction are relatively large and an outer dimension in a right/left direction is relatively small.

Electronic device 1 includes a device body 2 and electronic-component-equipped terminal block 3. Electronic-component-equipped terminal block 3 is attached to a cutout portion provided in a front-side lower portion of device body 2, and thus, electronic device 1 as a whole has a substantially rectangular parallelepiped outer shape as described above.

Various electronic components, wiring boards having the electronic components mounted thereon, and the like are accommodated in device body 2, and form function units of electronic device 1 required for temperature measurement, temperature adjustment and the like. Electronic-component-equipped terminal block 3 forms an input/output unit for electrically connecting these function units provided in device body 2 to an external device, a sensor (including a thermocouple) and the like.

As shown in FIGS. 1 to 3, electronic-component-equipped terminal block 3 includes a terminal block 10, an attachment assistance tool 100A and an electronic component 200. Electronic component 200 is a so-called cold junction sensor and is attached to terminal block 10 from outside. Attachment assistance tool 100A is interposed between electronic component 200 attached to terminal block 10 and terminal block 10.

Terminal block 10 has an elongated and substantially rectangular parallelepiped outer shape extending along the up/down direction, and has, in a front surface thereof, a plurality of sets of general-purpose terminal connection portions to which thermocouples and the like are connectable. Electronic component 200 is connected, from outside terminal block 10, to the set of general-purpose terminal connection portions located at the top, of the plurality of sets of general-purpose terminal connection portions. Attachment assistance tool 100A is mounted on the set of general-purpose terminal connection portions to which electronic component 200 is attached, and attachment assistance tool 100A is thereby interposed between electronic component 200 and terminal block 10.

The present embodiment illustrates the case in which electronic component 200 is attached to the set of general-purpose terminal connection portions located at the top, of the plurality of sets of general-purpose terminal connection portions. However, as a matter of course, electronic component 200 may be attached to another set of general-purpose terminal connection portions.

Terminal block 10 has a housing 11, which is an outer shell of terminal block 10, and housing 11 includes a front wall 12. Front wall 12 includes a plurality of through holes and a plurality of window portions that are provided in an array. The plurality of through holes and the plurality of window portions form the plurality of sets of general-purpose terminal connection portions. One set of general-purpose terminal connection portions includes a pair of right and left through holes (first through hole 13R and second through hole 13L), and a pair of right and left window portions (first window portion for operation 14R and second window portion for operation 14L).

Each of first through hole 13R and second through hole 13L is implemented by a substantially columnar hole portion provided in front wall 12, and penetrates through front wall 12 along a thickness direction thereof. Each of first window portion for operation 14R and second window portion for operation 14L is implemented by a substantially quadrangular prism-like hole portion provided in front wall 12, and penetrates through front wall 12 along the thickness direction thereof. First window portion for operation 14R is located above first through hole 13R, and second window portion for operation 14L is located above second through hole 13L.

Referring particularly to FIG. 3, electronic component 200 includes a component body 210, a pair of right and left leads (first lead 211R and second lead 211L), and a cylindrical cover member 220 that covers component body 210.

Component body 210 has a substantially columnar outer shape, and first lead 211R and second lead 211L extend in mutually opposite directions from an axial end surface of component body 210 along an axial direction of component body 210. In addition, first lead 211R and second lead 211L are bent at a midway position, such that tip-side portions thereof extend in the same direction. Cover member 220 is a member for protecting component body 210 from outside, and is also a member for thermally insulating component body 210 from the outside air.

Referring particularly to FIG. 3, attachment assistance tool 100A is implemented by an electrically insulating member including a base portion 110 located on the front side, and a pair of right and left insertion portions (first insertion portion 120R and second insertion portion 120L) protruding rearward from a rear surface of base portion 110, and is preferably implemented by an injection molded article made of resin. A material of attachment assistance tool 100A is not particularly limited as long as it is electrically insulating, and a polycarbonate resin or the like is, for example, selected as a particularly suitable material.

Base portion 110 is implemented by a flat frame-like member configured such that an outer dimension in the right/left direction is relatively large, an outer dimension in the up/down direction is relatively small, and an outer dimension in the front/rear direction is sufficiently small, and having a cut-out central portion. Each of first insertion portion 120R and second insertion portion 120L is implemented by a tubular member extending in the front/rear direction.

Although a specific structure thereof will be described in detail below, attachment assistance tool 100A is provided with a hollow first passage portion 121R extending from base portion 110 to first insertion portion 120R, and a hollow second passage portion 121L extending from base portion 110 to second insertion portion 120L. Base portion 110 of attachment assistance tool 100A is provided with a cutout-like receiving portion 113 at a front-side position of base portion 110.

Referring to FIGS. 1 to 3, in electronic-component-equipped terminal block 3, first insertion portion 120R of attachment assistance tool 100A is inserted into above-described first through hole 13R of terminal block 10 and second insertion portion 120L of attachment assistance tool 100A is inserted into above-described second through hole 13L of terminal block 10, thereby mounting attachment assistance tool 100A on the set of general-purpose terminal connection portions located at the top of terminal block 10.

Electronic component 200 is attached to the set of general-purpose terminal connection portions located at the top of terminal block 10, in a state where first lead 211R is inserted through above-described first passage portion 121R of attachment assistance tool 100A and second lead 211L is inserted through above-described second passage portion 121L of attachment assistance tool 100A. A rear portion of component body 210 of electronic component 200 and a rear portion of cover member 220 that covers component body 210 are accommodated in receiving portion 113 provided in base portion 110 of attachment assistance tool 100A.

B. Detailed Structure of Attachment Assistance Tool

Figure 4:
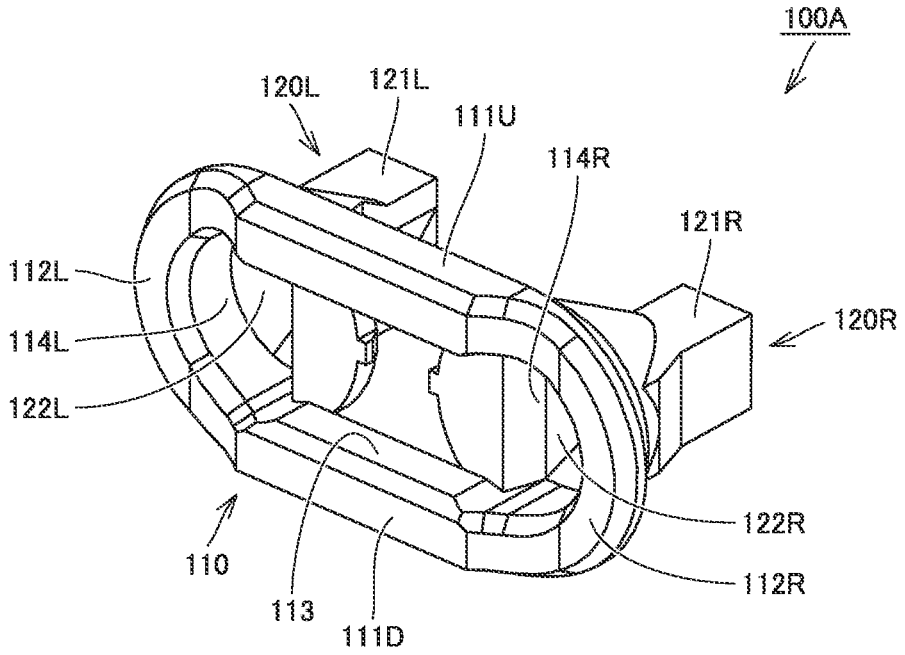
FIG. 4 is a perspective view of an attachment assistance tool for the electronic component according to the embodiment.
Figure 5:
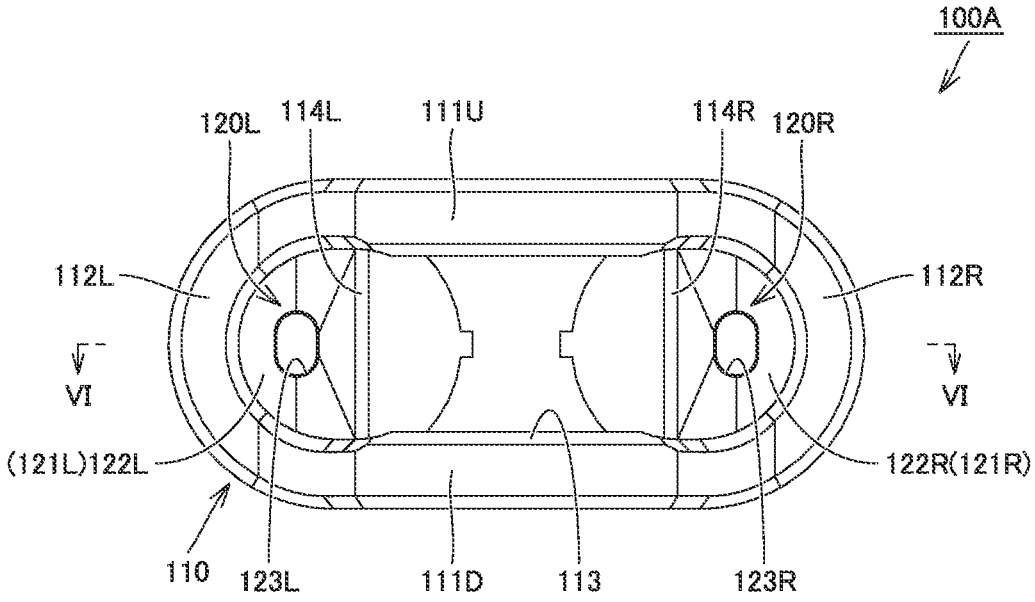
FIG. 5 is a front view of the attachment assistance tool for the electronic component according to the embodiment.
Figure 6:
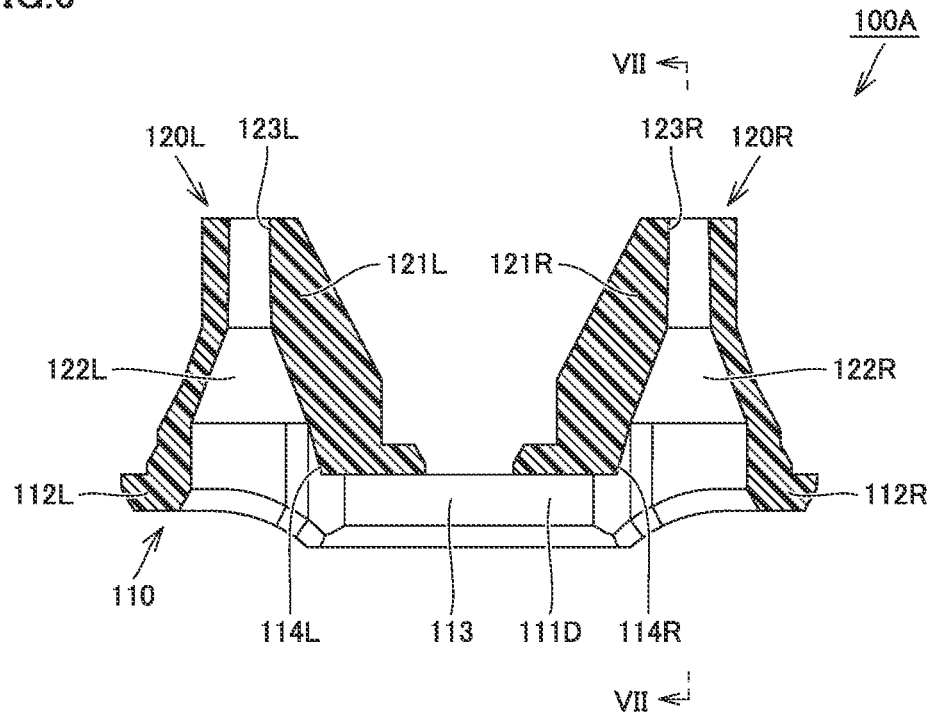
FIG. 6 is a cross-sectional view taken along line VI-VI shown in FIG. 5.
Figure 7:
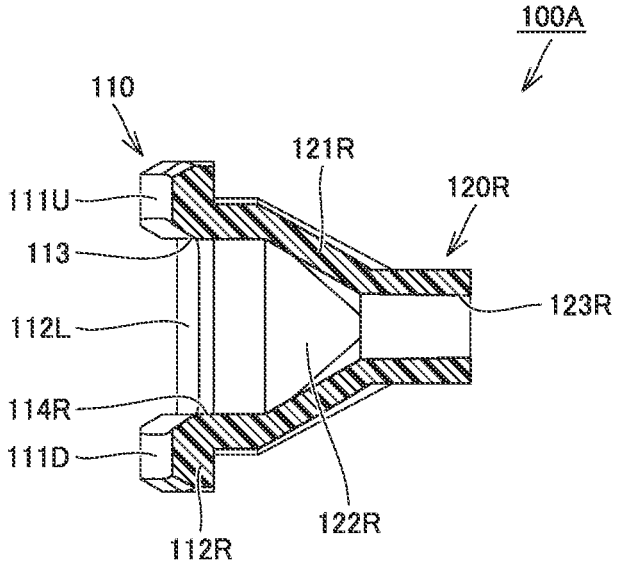
FIG. 7 is a cross-sectional view taken along line VII-VII shown in FIG. 6.

FIGS. 4 and 5 are a perspective view and a front view of the attachment assistance tool according to the embodiment, respectively. FIG. 6 is a cross-sectional view taken along line VI-VI shown in FIG. 5. FIG. 7 is a cross-sectional view taken along line VII-VII shown in FIG. 6. Next, a more detailed structure of attachment assistance tool 100A according to the embodiment will be described with reference to FIGS. 4 to 7.

As described above, as shown in FIGS. 4 to 7, attachment assistance tool 100A has base portion 110, and first insertion portion 120R and second insertion portion 120L. Base portion 110 is a portion that abuts against front wall 12 of terminal block 10 in a state where attachment assistance tool 100A is mounted on terminal block 10. First insertion portion 120R and second insertion portion 120L are portions that are inserted into first through hole 13R and second through hole 13L provided in front wall 12 of terminal block 10, respectively, in a state where attachment assistance tool 100A is mounted on terminal block 10.

Base portion 110 includes a pair of erected wall portions (upper-side erected wall portion 111U and lower-side erected wall portion 111D) that face each other in the up/down direction (i.e., in a direction orthogonal to a direction connecting first passage portion 121R and second passage portion 121L when viewed from the front side), and a pair of frame-like portions (first frame-like portion 112R and second frame-like portion 112L) located at both ends in the right/left direction.

Each of upper-side erected wall portion 111U and lower-side erected wall portion 111D extends along the right/left direction, and is generally located between first insertion portion 120R and second insertion portion 120L when viewed from the front side.

Upper-side erected wall portion 111U and lower-side erected wall portion 111D are portions that abut against front wall 12 of terminal block 10 in a state where attachment assistance tool 100A is mounted on terminal block 10. More specifically, a rear surface of upper-side erected wall portion 111U and a rear surface of lower-side erected wall portion 111D abut against front wall 12.

Receiving portion 113 defined by upper-side erected wall portion 111U and lower-side erected wall portion 111D is located between upper-side erected wall portion 111U and lower-side erected wall portion 111D. As described above, receiving portion 113 is a portion for receiving and accommodating the rear portion of cover member 220 of electronic component 200 and the rear portion of component body 210 covered with cover member 220.

Base portion 110 is not located between upper-side erected wall portion 111U and lower-side erected wall portion 111D when viewed from the front side, and this portion is open in the front/back direction. In the present embodiment, a part of first insertion portion 120R and a part of second insertion portion 120L are arranged at rear-side positions of this portion.

First frame-like portion 112R is implemented by an arc-shaped member that connects a right end of upper-side erected wall portion 111U and a right end of lower-side erected wall portion 111D, and surrounds first passage portion 121R described in detail below when viewed from the front side. Second frame-like portion 112L is implemented by an arc-shaped member that connects a left end of upper-side erected wall portion 111U and a left end of lower-side erected wall portion 111D, and surrounds second passage portion 121L described in detail below when viewed from the front side.

First frame-like portion 112R and second frame-like portion 112L are portions that abut against front wall 12 of terminal block 10 in a state where attachment assistance tool 100A is mounted on terminal block 10. More specifically, a rear surface of first frame-like portion 112R and a rear surface of second frame-like portion 112L abut against front wall 12.

First insertion portion 120R is implemented by a tubular member protruding rearward from a portion located close to a right end of the rear surface of base portion 110, and includes first passage portion 121R through which first lead 211R of electronic component 200 can be inserted. First passage portion 121R extends along the front/back direction, and a front end and a rear end thereof are open. The open end on the front end side of first passage portion 121R is defined by a front-side first opening 114R provided at a position close to the right end of base portion 110, and the open end on the rear end side of first passage portion 121R is defined by a rear-side first opening 123R provided at a rear end of first insertion portion 120R.

First passage portion 121R is provided with a first guide portion 122R having a passage cross-sectional area that decreases with increasing distance from base portion 110 (i.e., from a portion on the front-side first opening 114R side toward a portion on the rear-side first opening 123R side). First guide portion 122R is a portion for guiding first lead 211R to a below-described first terminal portion 16R (see FIG. 8) when first lead 211R of electronic component 200 is inserted through first passage portion 121R.

Second insertion portion 120L is implemented by a tubular member protruding rearward from a portion located close to a left end of the rear surface of base portion 110, and includes second passage portion 121L through which second lead 211L of electronic component 200 can be inserted. Second passage portion 121L extends along the front/back direction, and a front end and a rear end thereof are open. The open end on the front end side of second passage portion 121L is defined by a front-side second opening 114L provided at a position close to the left end of base portion 110, and the open end on the rear end side of second passage portion 121L is defined by a rear-side second opening 123L provided at a rear end of second insertion portion 120L.

Second passage portion 121L is provided with a second guide portion 122L having a passage cross-sectional area that decreases with increasing distance from base portion 110 (i.e., from a portion on the front-side second opening 114L side toward a portion on the rear-side second opening 123L side). Second guide portion 122L is a portion for guiding second lead 211L to a below-described second terminal portion 16L (see FIG. 8) when second lead 211L of electronic component 200 is inserted through second passage portion 121L.

Each of rear-side first opening 123R of first passage portion 121R and rear-side second opening 123L of second passage portion 121L has a vertically long hole shape in which a dimension in the up/down direction is relatively large and a dimension in the right/left direction is relatively small. With such a configuration, positioning in the right/left direction of first lead 211R and second lead 211L of electronic component 200 inserted through first passage portion 121R and second passage portion 121L can be performed more precisely.

C. Structure of Attachment of Electronic Component to Terminal Block

Figure 8:
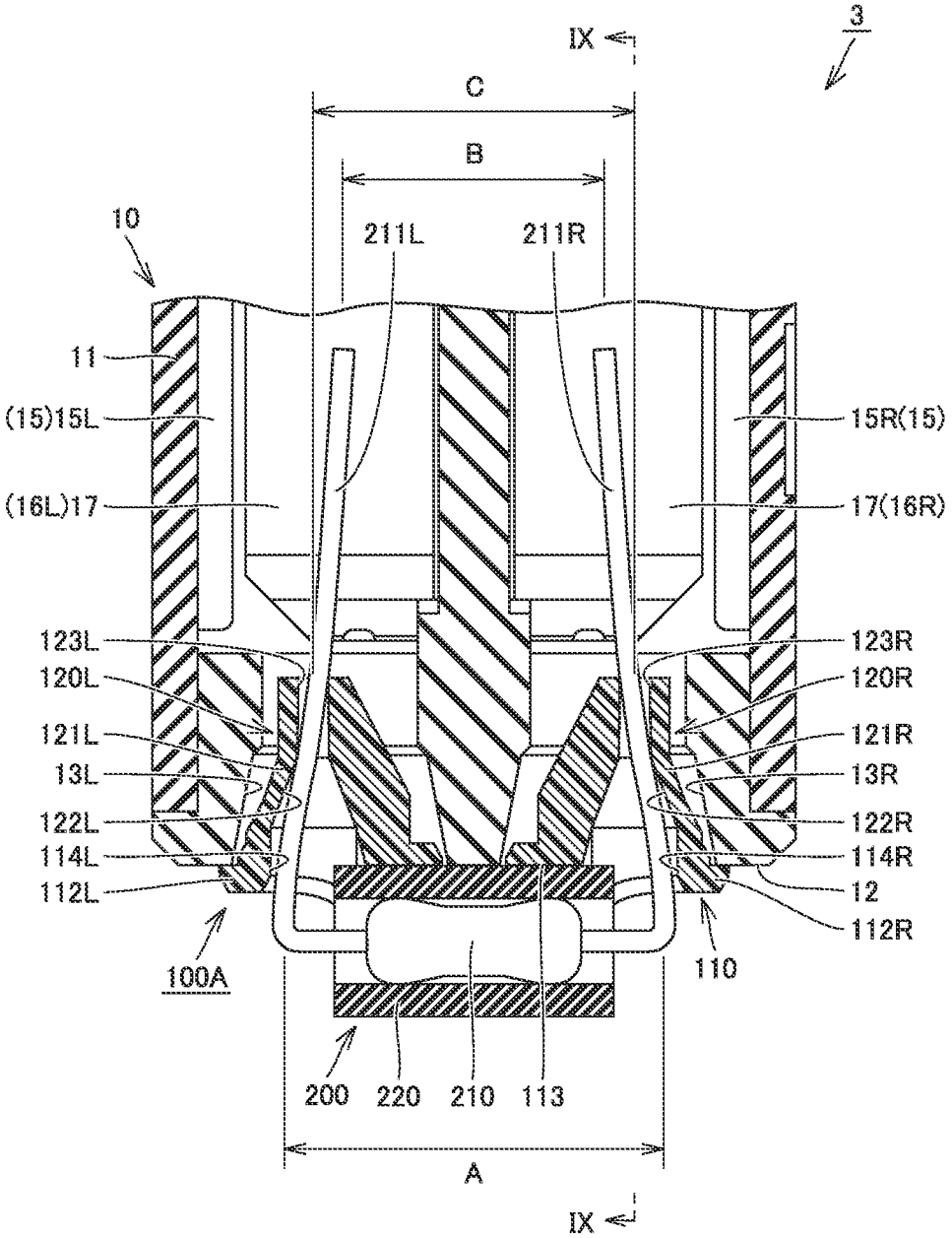
FIG. 8 is a cross-sectional view taken along line VIII-VIII shown in FIG. 2.
Figure 9:
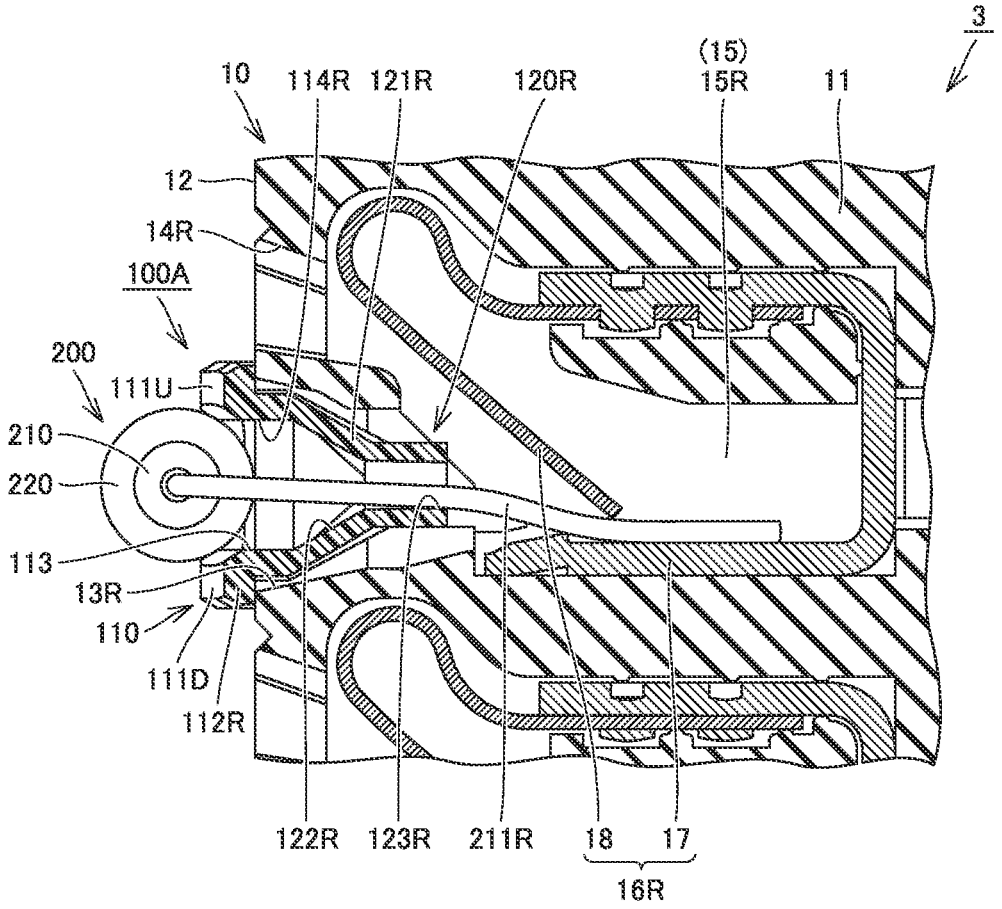
FIG. 9 is a cross-sectional view taken along line IX-IX shown in FIG. 8.

FIG. 8 is a cross-sectional view taken along line VIII-VIII shown in FIG. 2. FIG. 9 is a cross-sectional view taken along line IX-IX shown in FIG. 8. Next, a structure of attachment of electronic component 200 to terminal block 10 in electronic-component-equipped terminal block 3 according to the embodiment will be described in more detail with reference to FIGS. 8 and 9.

As shown in FIGS. 8 and 9, an accommodating portion 15 is provided inside housing 11 of terminal block 10 and behind front wall 12. Accommodating portion 15 includes a first accommodating portion 15R located on the right side of terminal block 10, and a second accommodating portion 15L located on the left side of terminal block 10. First accommodating portion 15R is located behind first through hole 13R, and second accommodating portion 15L is located behind second through hole 13L. In other words, first through hole 13R is provided in front wall 12 so as to reach first accommodating portion 15R provided inside housing 11, and second through hole 13L is provided in front wall 12 so as to reach second accommodating portion 15L provided inside housing 11.

First terminal portion 16R is arranged in first accommodating portion 15R so as to face first through hole 13R. Second terminal portion 16L is arranged in second accommodating portion 15L so as to face second through hole 13L. First terminal portion 16R and second terminal portion 16L are portions to which first lead 211R and second lead 211L of electronic component 200 are connected, respectively, and each of first terminal portion 16R and second terminal portion 16L includes a terminal body 17 and a plate spring 18.

Although first terminal portion 16R and second terminal portion 16L are partially different from each other in shape or the like in a strict sense, first terminal portion 16R and second terminal portion 16L basically have the same structure, and thus, attention will be focused on first terminal portion 16R and a structure thereof will be described below.

A part of terminal body 17 is arranged at a lower position of first accommodating portion 15R provided inside terminal block 10. On the other hand, plate spring 18 is arranged at an upper position of first accommodating portion 15R provided inside terminal block 10, so as to face the portion of terminal body 17 arranged at the lower position of first accommodating portion 15R. In the present embodiment, terminal body 17 has a substantially U shape in a side view, and plate spring 18 has a shape of being bent like a clip.

A tip of plate spring 18 abuts against terminal body 17, and plate spring 18 is in a state of being elastically biased with respect to terminal body 17 due to the elastic force of plate spring 18. Terminal body 17 is implemented by an electrically conductive member having relatively high rigidity. On the other hand, plate spring 18 is implemented by an elastic member, and may be implemented by an electrically conductive member or a non-electrically conductive member. Terminal body 17 is electrically connected to a not-shown circuit board at a rear-end-side position thereof.

Thus, when first lead 211R of electronic component 200 is inserted from the front between terminal body 17 and the portion of plate spring 18 that abuts against terminal body 17 (terminal body 17 and plate spring 18 form first terminal portion 16R), first lead 211R is sandwiched between terminal body 17 and plate spring 18, thereby connecting first lead 211R to first terminal portion 16R.

As described above, second terminal portion 16L also has a structure that is basically similar to that of first terminal portion 16R. Therefore, when second lead 211L of electronic component 200 is inserted from the front between terminal body 17 and the portion of plate spring 18 that abuts against terminal body 17 (terminal body 17 and plate spring 18 form second terminal portion 16L), second lead 211L is sandwiched between terminal body 17 and plate spring 18, thereby connecting second lead 211L to second terminal portion 16L.

A prescribed portion of plate spring 18 that forms first terminal portion 16R faces first window portion for operation 14R provided in front wall 12 of terminal block 10. A prescribed portion of plate spring 18 that forms second terminal portion 16L faces second window portion for operation 14L provided in front wall 12 of terminal block 10.

Thus, when a tool having a prescribed shape is inserted into first window portion for operation 14R and second window portion for operation 14L, the tool can be brought into contact with plate spring 18 and elastically deform plate spring 18, which makes it possible to release the abutment of plate spring 18 against terminal body 17. Therefore, by performing the above-described operation using the tool, insertion and removal of first lead 211R into/from first terminal portion 16R and insertion and removal of second lead 211L into/from second terminal portion 16L can be performed more easily.

As described above, electronic-component-equipped terminal block 3 according to the present embodiment is formed by attaching electronic component 200 to terminal block 10 in a state where attachment assistance tool 100A is interposed.

Specifically, as shown in FIGS. 8 and 9, base portion 110 of attachment assistance tool 100A is arranged outside housing 11 such that base portion 110 abuts against front wall 12 of terminal block 10 and a part thereof faces first through hole 13R and second through hole 13L, and first insertion portion 120R of attachment assistance tool 100A is inserted into first through hole 13R provided in front wall 12, and second insertion portion 120L of attachment assistance tool 100A is inserted into second through hole 13L provided in front wall 12.

Component body 210 of electronic component 200 is arranged outside housing 11 so as to face front wall 12 of terminal block 10, and first lead 211R of electronic component 200 is inserted through first through hole 13R provided in front wall 12 and connected to first terminal portion 16R, and second lead 211L of electronic component 200 is inserted through second through hole 13L provided in front wall 12 and connected to second terminal portion 16L.

As a result, the rear portion of cover member 220 of electronic component 200 and the rear portion of component body 210 covered with cover member 220 are in a state of being received and accommodated by receiving portion 113 provided in base portion 110 of attachment assistance tool 100A, and furthermore, first lead 211R of electronic component 200 is in a state of being inserted through first passage portion 121R provided to extend from base portion 110 to first insertion portion 120R of attachment assistance tool 100A, and second lead 211L of electronic component 200 is in a state of being inserted through second passage portion 121L provided to extend from base portion 110 to second insertion portion 120L of attachment assistance tool 100A.

With such a configuration, first insertion portion 120R and second insertion portion 120L of attachment assistance tool 100A are interposed between first through hole 13R provided in front wall 12 of terminal block 10 and first lead 211R of electronic component 200 and between second through hole 13L provided in front wall 12 of terminal block 10 and second lead 211L of electronic component 200. Therefore, a state of attachment of electronic component 200 to terminal block 10 is stabilized.

In addition, receiving portion 113 configured to receive and accommodate the rear portion of cover member 220 of electronic component 200 and the rear portion of component body 210 covered with cover member 220 is provided at the front-side position of attachment assistance tool 100A. Therefore, the state of attachment of electronic component 200 is stabilized. Besides that, electronic component 200 and attachment assistance tool 100A do not project greatly at the front-side position of terminal block 10, and thus, interference caused by electronic component 200 and attachment assistance tool 100A can be avoided.

In addition, since receiving portion 113 is located between first passage portion 121R and second passage portion 121L, cover member 220 of electronic component 200 and component body 210 covered with cover member 220, rear portions of which are accommodated in receiving portion 113, are arranged between first through hole 13R and second through hole 13L at the front-side position of terminal block 10.

Therefore, with such a configuration, electronic component 200 and attachment assistance tool 100A do not greatly project outward (i.e., in the right/left direction, in the up/down direction, and the like) from the front-side region of the portion of terminal block 10 provided with first through hole 13R and second through hole 13L, and thus, interference caused by electronic component 200 and attachment assistance tool 100A can be further avoided.

In addition, receiving portion 113 is defined by upper-side erected wall portion 111U and lower-side erected wall portion 111D that face each other in the up/down direction. Therefore, at the front-side position of terminal block 10, the rear portion of cover member 220 of electronic component 200 and the rear portion of component body 210 covered with cover member 220 can be sandwiched along the up/down direction. Therefore, electronic component 200 can be received and accommodated more stably by receiving portion 113.

In addition, base portion 110 is not located between upper-side erected wall portion 111U and lower-side erected wall portion 111D, when viewed from the front side. Thus, attachment assistance tool 100A is not located between the rear surface of the portion of electronic component 200 accommodated in receiving portion 113 and front wall 12 of terminal block 10. Therefore, an amount of projection of electronic component 200 and attachment assistance tool 100A at the front-side position of terminal block 10 can be minimized. Thus, interference caused by electronic component 200 and attachment assistance tool 100A can be avoided at the maximum.

In addition, base portion 110 is provided with not only upper-side erected wall portion 111U and lower-side erected wall portion 111D but also first frame-like portion 112R and second frame-like portion 112L. Therefore, the rear surface of each of upper-side erected wall portion 111U, lower-side erected wall portion 111D, first frame-like portion 112R, and second frame-like portion 112L abuts against front wall 12 of terminal block 10. Thus, attachment assistance tool 100A interposed between electronic component 200 and terminal block 10 is positioned and held with respect to terminal block 10 more stably. As a result, the state of attachment of electronic component 200 to terminal block 10 can be further stabilized.

As described above, in electronic-component-equipped terminal block 3 according to the present embodiment, first passage portion 121R and second passage portion 121L of attachment assistance tool 100A are provided with first guide portion 122R and second guide portion 122L described above, respectively. Therefore, when electronic component 200 is attached to terminal block 10, first lead 211R and second lead 211L of electronic component 200 are guided by first guide portion 122R and second guide portion 122L and connected to first terminal portion 16R and second terminal portion 16L, respectively. Therefore, the appropriate connection positions can be achieved and the attachment work can be simplified. After electronic component 200 is attached, the occurrence of misalignment of first lead 211R and second lead 211L in the direction orthogonal to the connection directions of first lead 211R and second lead 211L (i.e., in the right/left direction, in the up/down direction, and the like) can be suppressed, and as a result, the occurrence of a connection failure can be prevented.

Referring to FIG. 8, when a distance A between the bent portions of first lead 211R and second lead 211L of electronic component 200 does not match a pitch B between first terminal portion 16R and second terminal portion 16L, it is particularly suitable to provide first guide portion 122R and second guide portion 122L described above in attachment assistance tool 100A. That is, the orientation of first lead 211R and second lead 211L is corrected by first guide portion 122R and second guide portion 122L when electronic component 200 is attached to terminal block 10, and thus, the position of connection of first lead 211R to first terminal portion 16R and the position of connection of second lead 211L to second terminal portion 16L can be adjusted to desired positions. Therefore, even when external force is applied to electronic component 200, terminal block 10, electronic device 100 and the like, the occurrence of a connection failure of electronic component 200 can be significantly suppressed.

In the example shown in FIG. 8, distance A between the bent portions of first lead 211R and second lead 211L of electronic component 200 is longer than pitch B between first terminal portion 16R and second terminal portion 16L. In this case, a pitch C between rear-side first opening 123R of first passage portion 121R and rear-side second opening 123L of second passage portion 121L is preferably set to be shorter than above-described distance A and longer than above-described pitch B.

In contrast, when distance A between the bent portions of first lead 211R and second lead 211L of electronic component 200 is shorter than pitch B between first terminal portion 16R and second terminal portion 16L, pitch C between rear-side first opening 123R of first passage portion 121R and rear-side second opening 123L of second passage portion 121L is preferably set to be longer than above-described distance A and shorter than above-described pitch B.

When distance A between the bent portions of first lead 211R and second lead 211L of electronic component 200 is the same as pitch B between first terminal portion 16R and second terminal portion 16L, pitch C between rear-side first opening 123R of first passage portion 121R and rear-side second opening 123L of second passage portion 121L is preferably set to be the same as above-described distance A and pitch B.

That is, it is preferable to design above-described attachment assistance tool 100A such that rear-side first opening 123R is located on a line segment connecting the bent portion of first lead 211R and a target position of connection of first terminal portion 16R to first lead 211R, and rear-side second opening 123L is located on a line segment connecting the bent portion of second lead 211L and a target position of connection of second terminal portion 16L to second lead 211L, after electronic component 200 is attached to terminal block 10. By designing attachment assistance tool 100A as described above, the occurrence of a connection failure of electronic component 200 can be significantly suppressed.

D. Summary

As described above, electronic-component-equipped terminal block 3 according to the present embodiment, and electronic device 1 including the same according to the present embodiment can be an electronic-component-equipped terminal block, and an electronic device including the same, in which a state of attachment of electronic component 200 to terminal block 10 is stabilized. In addition, attachment assistance tool 100A according to the present embodiment can be an attachment assistance tool for an electronic component that can stabilize the attachment state when electronic component 200 is attached to terminal block 10.

E. Modifications

Figure 10:
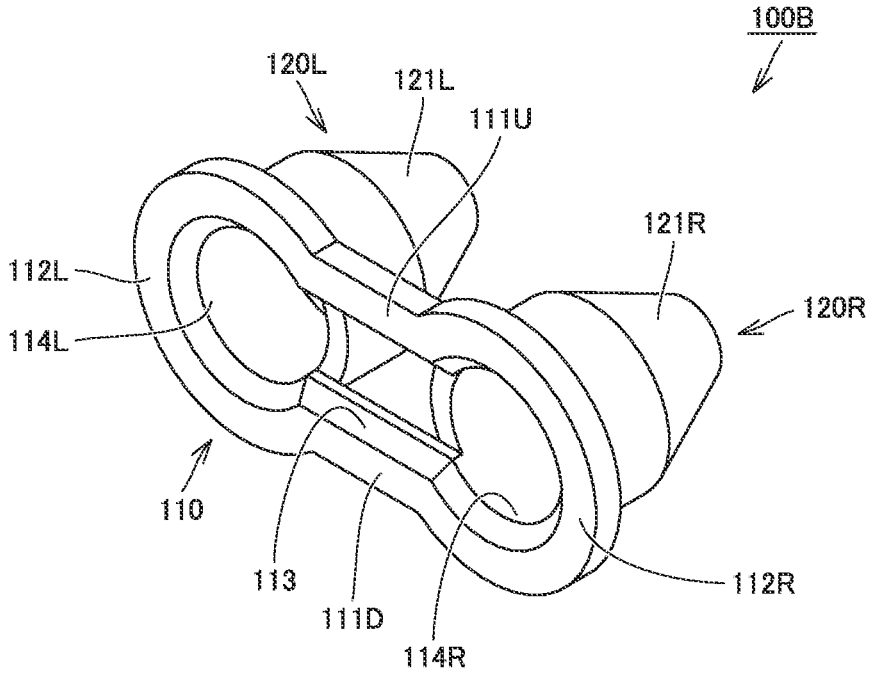
FIG. 10 is a perspective view of an attachment assistance tool for an electronic component according to a first modification.
Figure 11:
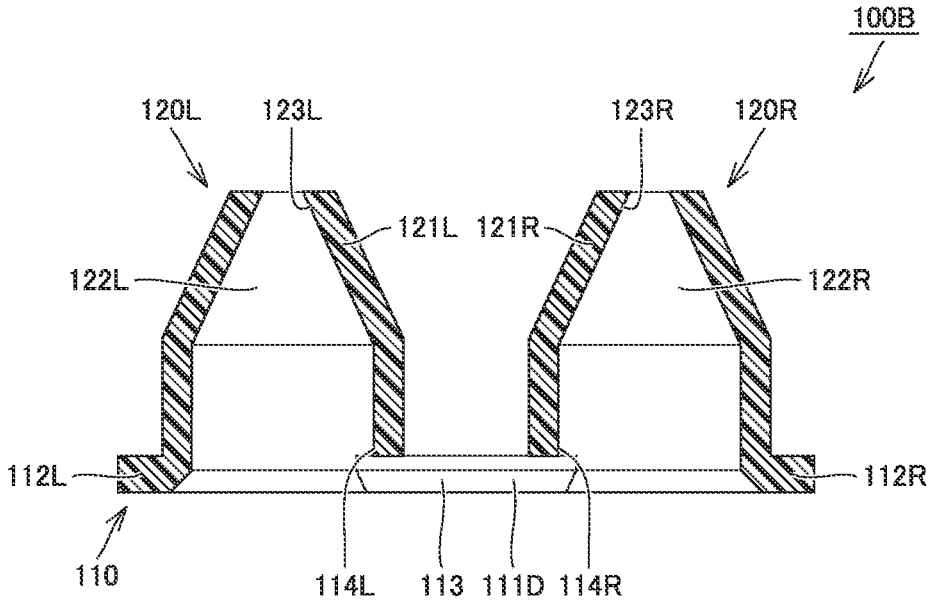
FIG. 11 is a cross-sectional view of the attachment assistance tool for the electronic component according to the first modification.

FIGS. 10 and 11 are a perspective view and a cross-sectional view of an attachment assistance tool according to a first modification based on the above-described embodiment, respectively. An attachment assistance tool 100B according to the first modification will be described below with reference to FIGS. 10 and 11. Attachment assistance tool 100B is used in above-described electronic device 1 and above-described electronic-component-equipped terminal block 3 included therein, instead of attachment assistance tool 100A according to the above-described embodiment.

As shown in FIGS. 10 and 11, when attachment assistance tool 100B according to the first modification is compared with attachment assistance tool 100A according to the above-described embodiment, base portion 110, first insertion portion 120R and second insertion portion 120L have different shapes. Specifically, in attachment assistance tool 100B, first frame-like portion 112R and second frame-like portion 112L extending in an arc shape are formed to be longer, and thus, upper-side erected wall portion 111U and lower-side erected wall portion 111D are formed to be shorter and a distance therebetween is shorter. In addition, each of first passage portion 121R and second passage portion 121L is formed such that a front-end-side portion thereof has a substantially columnar space and a rear-end-side portion thereof has a substantially circular truncated conical space.

Such a configuration is basically similar to that of the above-described embodiment. Therefore, in an electronic-component-equipped terminal block and an electronic device including attachment assistance tool 100B, the state of attachment of the electronic component to the terminal block is stabilized. In addition, by using attachment assistance tool 100B, the attachment state can be stabilized when the electronic component is attached to the terminal block.

Figure 12:
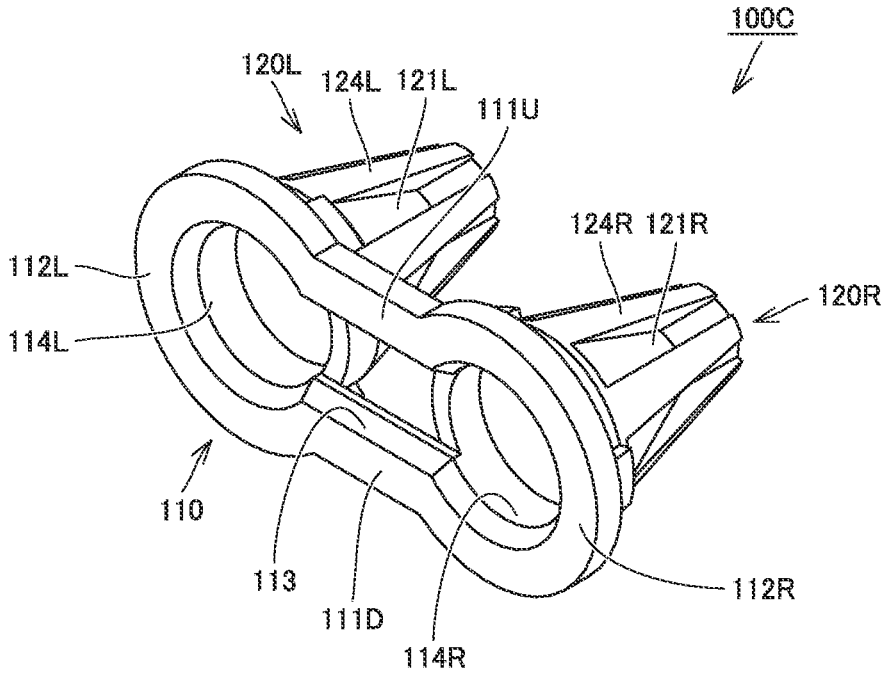
FIG. 12 is a perspective view of an attachment assistance tool for an electronic component according to a second modification.
Figure 13:
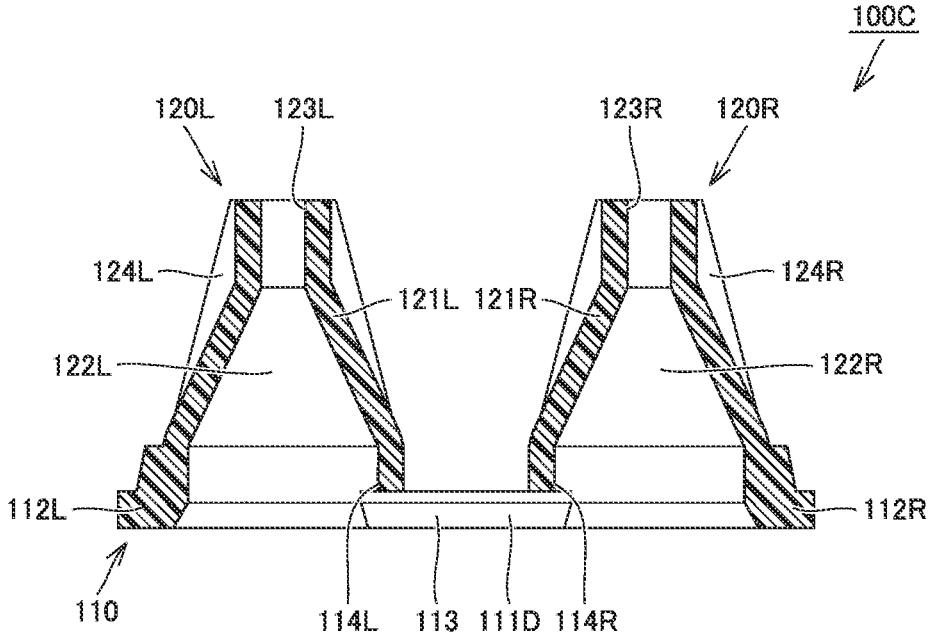
FIG. 13 is a cross-sectional view of the attachment assistance tool for the electronic component according to the second modification.

FIGS. 12 and 13 are a perspective view and a cross-sectional view of an attachment assistance tool according to a second modification based on the above-described embodiment, respectively. An attachment assistance tool 100C according to the second modification will be described below with reference to FIGS. 12 and 13. Attachment assistance tool 100C is used in above-described electronic device 1 and above-described electronic-component-equipped terminal block 3 included therein, instead of attachment assistance tool 100A according to the above-described embodiment.

As shown in FIGS. 12 and 13, when attachment assistance tool 100C according to the second modification is compared with attachment assistance tool 100B according to the above-described first modification, first insertion portion 120R and second insertion portion 120L have a different shape. Specifically, in attachment assistance tool 100C, each of first passage portion 121R and second passage portion 121L is formed such that a front-end-side portion thereof has a substantially circular truncated conical space and a rear-end-side portion thereof has a substantially columnar space. In addition, a first rib 124R and a second rib 124L are provided on outer circumferential surfaces of first insertion portion 120R and second insertion portion 120L, respectively.

Such a configuration is basically similar to that of the above-described embodiment. Therefore, in an electronic-component-equipped terminal block and an electronic device including attachment assistance tool 100C, the state of attachment of the electronic component to the terminal block is stabilized. In addition, by using attachment assistance tool 100C, the attachment state can be stabilized when the electronic component is attached to the terminal block.

Figure 14:
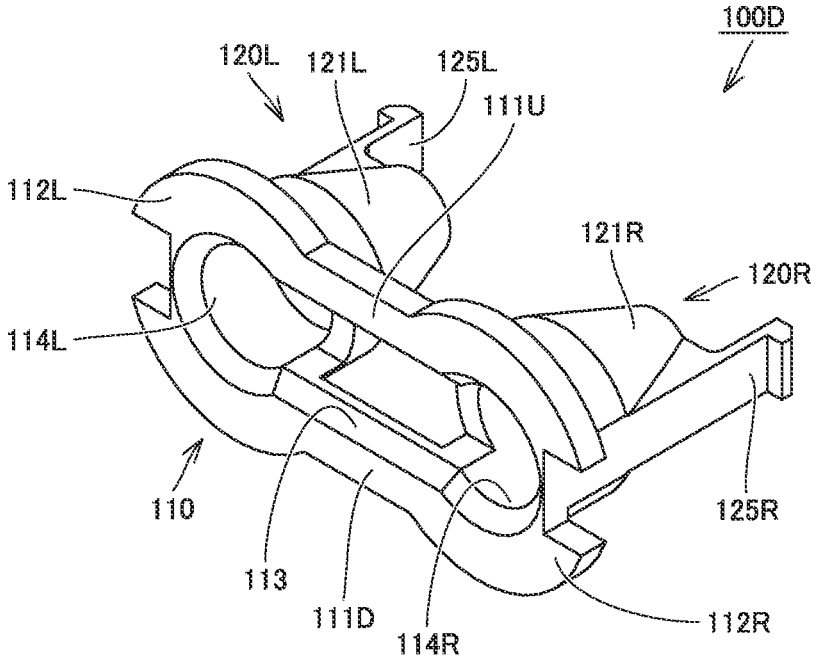
FIG. 14 is a perspective view of an attachment assistance tool for an electronic component according to a third modification.
Figure 15:
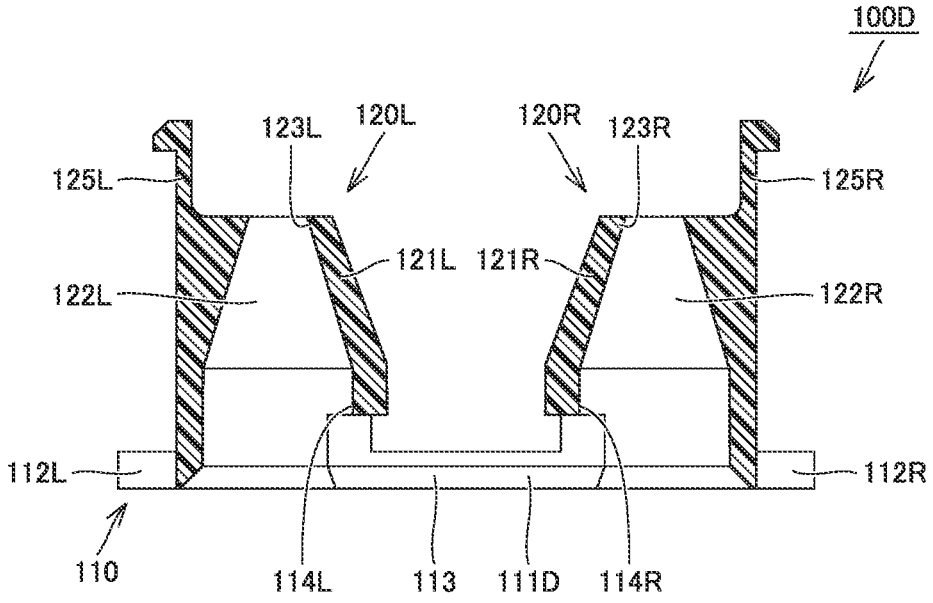
FIG. 15 is a cross-sectional view of the attachment assistance tool for the electronic component according to the third modification.

FIGS. 14 and 15 are a perspective view and a cross-sectional view of an attachment assistance tool according to a third modification based on the above-described embodiment, respectively. An attachment assistance tool 100D according to the third modification will be described below with reference to FIGS. 14 and 15. Attachment assistance tool 100D is used in above-described electronic device 1 and above-described electronic-component-equipped terminal block 3 included therein, instead of attachment assistance tool 100A according to the above-described embodiment.

As shown in FIGS. 14 and 15, when attachment assistance tool 100D according to the third modification is compared with attachment assistance tool 100B according to the above-described first modification, base portion 110, first insertion portion 120R and second insertion portion 120L have different shapes. Specifically, in attachment assistance tool 100D, each of first frame-like portion 112R and second frame-like portion 112L extending in an arc shape is cut out at a prescribed position, and first insertion portion 120R and second insertion portion 120L are provided with a first engagement portion 125R and a second engagement portion 125L, respectively.

First engagement portion 125R and second engagement portion 125L are portions for more firmly fixing attachment assistance tool 100D to front wall 12 of terminal block 10. A hook portion is provided at a rear end portion of each of first engagement portion 125R and second engagement portion 125L, thereby sandwiching front wall 12 between base portion 110 and the hook portion in the attachment state.

Such a configuration is basically similar to that of the above-described embodiment. Therefore, in an electronic-component-equipped terminal block and an electronic device including attachment assistance tool 100D, the state of attachment of the electronic component to the terminal block is stabilized. In addition, by using attachment assistance tool 100D, the attachment state can be stabilized when the electronic component is attached to the terminal block.

F. Supplementary Notes

The above-described embodiment and the first to third modifications based on the embodiment include the following technical ideas.

Configuration 1

An electronic-component-equipped terminal block (3) comprising:

a terminal block (10);

an electronic component (200) attached to the terminal block (10); and an electrically insulating attachment assistance tool (100A, 100B, 100C, 100D) interposed between the electronic component (200) and the terminal block (10), wherein the terminal block (10) includes:

a housing (11) having, in a front wall (12) thereof, a first through hole (13R) and a second through hole (13L) provided to reach an accommodating portion (15) formed inside the housing (11);

a first terminal portion (16R) arranged in the accommodating portion (15) so as to face the first through hole (13R); and a second terminal portion (16L) arranged in the accommodating portion (15) so as to face the second through hole (13L), the electronic component (200) includes:

a component body (210, 220) arranged outside the housing (11) so as to face the front wall (12);

a first lead (211R) inserted through the first through hole (13R) and connected to the first terminal portion (16R); and a second lead (211L) inserted through the second through hole (13L) and connected to the second terminal portion (16L), the attachment assistance tool (100A, 100B, 100C, 100D) includes:

a base portion (110) arranged outside the housing (11) such that a rear surface thereof abuts against the front wall (12) and a part thereof faces the first through hole (13R) and the second through hole (13L);

a first insertion portion (120R) protruding from the rear surface of the base portion (110) to be thereby inserted into the first through hole (13R); and a second insertion portion (120L) protruding from the rear surface of the base portion (110) to be thereby inserted into the second through hole (13L), a hollow first passage portion (121R) through which the first lead (211R) is inserted is provided to extend from the base portion (110) to the first insertion portion (120R), a hollow second passage portion (121L) through which the second lead (211L) is inserted is provided to extend from the base portion (110) to the second insertion portion (120L), and a receiving portion (113) that receives and accommodates at least a rear portion of the component body (210, 220) is provided at a front-side position of the base portion (110).

Configuration 2

The electronic-component-equipped terminal block according to Configuration 1, wherein the receiving portion (113) is located at least between the first passage portion (121R) and the second passage portion (121L).

Configuration 3

The electronic-component-equipped terminal block according to Configuration 2, wherein the base portion (110) has a pair of erected wall portions (111U, 111D) that face each other in a direction orthogonal to a direction connecting the first passage portion (121R) and the second passage portion (121L), when viewed from a front side, and the receiving portion (113) is defined by the pair of erected wall portions (111U, 111D).

Configuration 4

The electronic-component-equipped terminal block according to Configuration 3, wherein the base portion (110) is not located between the pair of erected wall portions (111U, 111D), when viewed from the front side.

Configuration 5

The electronic-component-equipped terminal block according to any one of Configurations 1 to 4, wherein the first passage portion (121R) has a first guide portion (122R) having a passage cross-sectional area that decreases with increasing distance from the base portion (110), to thereby guide the first lead (211R) to the first terminal portion (16R), and the second passage portion (121L) has a second guide portion (122L) having a passage cross-sectional area that decreases with increasing distance from the base portion (110), to thereby guide the second lead (211L) to the second terminal portion (16L).

Configuration 6

The electronic-component-equipped terminal block according to any one of Configurations 1 to 5, wherein the base portion (110) is provided with a first frame-like portion (112R) that surrounds at least a part of the first passage portion (121R) when viewed from the front side, the base portion is provided with a second frame-like portion (112L) that surrounds at least a part of the second passage portion (121L) when viewed from the front side, and each of a rear surface of the first frame-like portion (112R) and a rear surface of the second frame-like portion (112L) abuts against the front wall (12).

Configuration 7

An electronic device comprising the electronic-component-equipped terminal block (3) as recited in any one of Configurations 1 to 6.

Configuration 8

An attachment assistance tool (100A, 100B, 100C, 100D) for an electronic component configured to be interposed between an electronic component attached to a terminal block and the terminal block, the attachment assistance tool (100A, 100B, 100C, 100D) comprising:

a base portion (110) configured to be arranged outside a housing of the terminal block such that a rear surface thereof abuts against a front wall of the housing and a part thereof faces a first through hole of the terminal block and a second through hole of the terminal block;

a first insertion portion (120R) protruding from the rear surface of the base portion (110) to be thereby inserted into the first through hole of the terminal block; and a second insertion portion (120L) protruding from the rear surface of the base portion (110) to be thereby inserted into the second through hole of the terminal block, wherein a hollow first passage portion (121R) through which a first lead of the electronic component is inserted is provided to extend from the base portion (110) to the first insertion portion (120R), a hollow second passage portion (121L) through which a second lead of the electronic component is inserted is provided to extend from the base portion (110) to the second insertion portion (120L), and a receiving portion (113) configured to receive and accommodate at least a rear portion of a component body of the electronic component is provided at a front-side position of the base portion (110).

G. Others

In the above-described embodiment and the first to third modifications based on the embodiment, description has been given by way of example of the case in which the receiving portion provided in the base portion of the attachment assistance tool is formed by the upper-side erected wall portion and the lower-side erected wall portion that face each other in the up/down direction, and the base portion is not located between the upper-side erected wall portion and the lower-side erected wall portion. However, the configuration of the receiving portion is not limited to the above-described configuration, and the receiving portion may have another shape. For example, the receiving portion may be formed by a recessed portion provided on the front surface side of the base portion.

In addition, in the above-described embodiment and the first to third modifications based on the embodiment, description has been given by way of example of the case in which the present disclosure is applied to the temperature measuring unit of the PLC, the electronic-component-equipped terminal block included therein, and the attachment assistance tool for the electronic component used therefor. However, the present disclosure is not limited to being applied thereto. The characteristic features of the present disclosure can be applied to various types of electronic devices, electronic-component-equipped terminal blocks included therein, and attachment assistance tools for electronic components used therefor.

In addition, the characteristic features mentioned in the above-described embodiment and the first to third modifications based on the embodiment can be combined with each other within the scope not deviating from the subject of the present invention.

As described above, the embodiment and the modifications thereof disclosed herein are illustrative and non-restrictive in every respect. The technical scope of the present invention is defined by the terms of the claims and is intended to include any modifications within the scope and meaning equivalent to the terms of the claims.

REFERENCE SIGNS LIST

1 electronic device; 2 device body; 3 electronic-component-equipped terminal block; 10 terminal block; 11 housing; 12 front wall; 13R first through hole; 13L second through hole; 14R first window portion for operation; 14L second window portion for operation; 15 accommodating portion; 15R first accommodating portion; 15L second accommodating portion; 16R first terminal portion; 16L second terminal portion; 17 terminal body; 18 plate spring; 100A to 100D attachment assistance tool; 110 base portion; 111U upper-side erected wall portion; 111D lower-side erected wall portion; 112R first frame-like portion; 112L second frame-like portion; 113 receiving portion; 114R front-side first opening; 114L front-side second opening; 120R first insertion portion; 120L second insertion portion; 121R first passage portion; 121L second passage portion; 122R first guide portion; 122L second guide portion; 123R rear-side first opening; 123L rear-side second opening; 124R first rib; 124L second rib; 125R first engagement portion; 125L second engagement portion; 200 electronic component; 210 component body; 211R first lead; 211L second lead; 220 cover member.

The invention claimed is:

1. An electronic-component-equipped terminal block comprising:

a terminal block;

an electronic component attached to the terminal block; and an electrically insulating attachment assistance tool interposed between the electronic component and the terminal block, wherein the terminal block includes:

a housing having, in a front wall thereof, a first through hole and a second through hole provided to reach an accommodating portion formed inside the housing;

a first terminal portion arranged in the accommodating portion so as to face the first through hole; and a second terminal portion arranged in the accommodating portion so as to face the second through hole, the electronic component includes:

a component body arranged outside the housing so as to face the front wall;

a first lead inserted through the first through hole and connected to the first terminal portion; and a second lead inserted through the second through hole and connected to the second terminal portion, the electrically insulating attachment assistance tool includes:

a base portion arranged outside the housing such that a rear surface thereof abuts against the front wall and a part thereof faces the first through hole and the second through hole;

a first insertion portion protruding from the rear surface of the base portion to be thereby inserted into the first through hole; and a second insertion portion protruding from the rear surface of the base portion to be thereby inserted into the second through hole, a first passage portion through which the first lead is inserted is provided to extend from the base portion to the first insertion portion, a second passage portion through which the second lead is inserted is provided to extend from the base portion to the second insertion portion, and a receiving portion that receives and accommodates at least a rear portion of the component body is provided at a front-side position of the base portion.

2. The electronic-component-equipped terminal block according to claim 1, wherein the first passage portion has a first guide portion having a passage cross-sectional area that decreases with increasing distance from the base portion, to thereby guide the first lead to the first terminal portion, and the second passage portion has a second guide portion having a passage cross-sectional area that decreases with increasing distance from the base portion, to thereby guide the second lead to the second terminal portion.

3. The electronic-component-equipped terminal block according to claim 1, wherein the base portion is provided with a first frame-like portion that surrounds at least a part of the first passage portion when viewed from the front side, the base portion is provided with a second frame-like portion that surrounds at least a part of the second passage portion when viewed from the front side, and each of a rear surface of the first frame-like portion and a rear surface of the second frame-like portion abuts against the front wall.

4. The electronic-component-equipped terminal block according to claim 1, wherein the receiving portion is located at least between the first passage portion and the second passage portion.

5. The electronic-component-equipped terminal block according to claim 4, wherein the base portion has a pair of erected wall portions that face each other in a direction orthogonal to a direction connecting the first passage portion and the second passage portion, when viewed from a front side, and the receiving portion is defined by the pair of erected wall portions.

6. The electronic-component-equipped terminal block according to claim 5, wherein the base portion is not located between the pair of erected wall portions, when viewed from the front side.

7. An electronic device comprising an electronic-component-equipped terminal block comprising:

a terminal block;

an electronic component attached to the terminal block; and an electrically insulating attachment assistance tool interposed between the electronic component and the terminal block, wherein the terminal block includes:

a housing having, in a front wall thereof, a first through hole and a second through hole provided to reach an accommodating portion formed inside the housing;

a first terminal portion arranged in the accommodating portion so as to face the first through hole; and a second terminal portion arranged in the accommodating portion so as to face the second through hole, the electronic component includes:

a component body arranged outside the housing so as to face the front wall;

a first lead inserted through the first through hole and connected to the first terminal portion; and a second lead inserted through the second through hole and connected to the second terminal portion, the electrically insulating attachment assistance tool includes:

a base portion arranged outside the housing such that a rear surface thereof abuts against the front wall and a part thereof faces the first through hole and the second through hole;

a first insertion portion protruding from the rear surface of the base portion to be thereby inserted into the first through hole; and a second insertion portion protruding from the rear surface of the base portion to be thereby inserted into the second through hole, a first passage portion through which the first lead is inserted is provided to extend from the base portion to the first insertion portion, a second passage portion through which the second lead is inserted is provided to extend from the base portion to the second insertion portion, and a receiving portion that receives and accommodates at least a rear portion of the component body is provided at a front-side position of the base portion.

8. The electronic device according to claim 7, wherein:

the first passage portion has a first guide portion having a passage cross-sectional area that decreases with increasing distance from the base portion, to thereby guide the first lead to the first terminal portion, and the second passage portion has a second guide portion having a passage cross-sectional area that decreases with increasing distance from the base portion, to thereby guide the second lead to the second terminal portion.

9. The electronic device according to claim 7, wherein:

the base portion is provided with a first frame-like portion that surrounds at least a part of the first passage portion when viewed from the front side, the base portion is provided with a second frame-like portion that surrounds at least a part of the second passage portion when viewed from the front side, and each of a rear surface of the first frame-like portion and a rear surface of the second frame-like portion abuts against the front wall.

10. The electronic device according to claim 7, wherein:

the receiving portion is located at least between the first passage portion and the second passage portion.

11. The electronic device according to claim 10, wherein:

the base portion has a pair of erected wall portions that face each other in a direction orthogonal to a direction connecting the first passage portion and the second passage portion, when viewed from a front side, and the receiving portion is defined by the pair of erected wall portions.

12. The electronic device according to claim 11, wherein:

the base portion is not located between the pair of erected wall portions, when viewed from the front side.

13. An attachment assistance tool for an electronic component configured to be interposed between an electronic component attached to a terminal block and the terminal block, the attachment assistance tool comprising:

a base portion configured to be arranged outside a housing of the terminal block such that a rear surface thereof abuts against a front wall of the housing and a part thereof faces a first through hole of the terminal block and a second through hole of the terminal block;

a first insertion portion protruding from the rear surface of the base portion to be thereby inserted into the first through hole of the terminal block; and a second insertion portion protruding from the rear surface of the base portion to be thereby inserted into the second through hole of the terminal block, wherein a first passage portion through which a first lead of the electronic component is inserted is provided to extend from the base portion to the first insertion portion, a second passage portion through which a second lead of the electronic component is inserted is provided to extend from the base portion to the second insertion portion, and a receiving portion configured to receive and accommodate at least a rear portion of a component body of the electronic component is provided at a front-side position of the base portion.

14. The attachment assistance tool for an electronic component according to claim 13, wherein the first passage portion has a first guide portion having a passage cross-sectional area that decreases with increasing distance from the base portion, to thereby guide the first lead to a first terminal portion, and the second passage portion has a second guide portion having a passage cross-sectional area that decreases with increasing distance from the base portion, to thereby guide the second lead to a second terminal portion.

15. The attachment assistance tool for an electronic component according to claim 13, wherein the base portion is provided with a first frame-like portion that surrounds at least a part of the first passage portion when viewed from the front side, and the base portion is provided with a second frame-like portion that surrounds at least a part of the second passage portion when viewed from the front side.

16. The attachment assistance tool for an electronic component according to claim 13, wherein the receiving portion is located at least between the first passage portion and the second passage portion.

17. The attachment assistance tool for an electronic component according to claim 16, wherein the base portion has a pair of erected wall portions that face each other in a direction orthogonal to a direction connecting the first passage portion and the second passage portion, when viewed from a front side, and the receiving portion is defined by the pair of erected wall portions.

18. The attachment assistance tool for an electronic component according to claim 17, wherein the base portion is not located between the pair of erected wall portions, when viewed from the front side.

* * * * *